US006516967B2

(12) United States Patent
Duff et al.

(10) Patent No.: US 6,516,967 B2
(45) Date of Patent: Feb. 11, 2003

(54) CANNED AND BOTTLED BEVERAGE HOLDER

(76) Inventors: Scott B. Duff, 23 Meandering Way, Round Rock, TX (US) 78664; Carlos E. Ortiz, 1808 Lemon Mint Ct., Austin, TX (US) 78701

( * ) Notice: Subject to any disclaimer, the term of this patent is extended or adjusted under 35 U.S.C. 154(b) by 0 days.

(21) Appl. No.: 09/879,685

(22) Filed: Jun. 12, 2001

(65) Prior Publication Data

US 2002/0014491 A1 Feb. 7, 2002

Related U.S. Application Data

(63) Continuation-in-part of application No. 09/591,921, filed on Jun. 12, 2000, now abandoned.

(51) Int. Cl.[7] ..... B65D 23/00

(52) U.S. Cl. ..... 220/592.16; 220/592.17; 220/737; 220/739

(58) Field of Search ..... 220/592.16, 592.17, 220/592.23, 710.5, 737, 739

(56) References Cited

U.S. PATENT DOCUMENTS

| | | | | | |
|---|---|---|---|---|---|
| 3,257,025 | A | * | 6/1966 | Jolly | 220/739 |
| 3,766,975 | A | * | 10/1973 | Todd | 220/592.17 X |
| 4,299,100 | A | * | 11/1981 | Crisman et al. | 220/592.17 X |
| 4,383,422 | A | * | 5/1983 | Gordon et al. | 220/592.16 X |
| 4,720,023 | A | * | 1/1988 | Jeff | 220/592.17 |
| 4,771,911 | A | * | 9/1988 | Morony et al. | 220/737 X |
| 5,573,141 | A | * | 11/1996 | Chen | 220/739 X |
| 6,050,443 | A | * | 4/2000 | Tung | 220/592.17 |

* cited by examiner

*Primary Examiner*—Steven Pollard
(74) *Attorney, Agent, or Firm*—Rick B. Yeager

(57) ABSTRACT

A holder for a beverage container, typically a beverage can or a beverage bottle, to provide supplemental cooling to the beverage. The holder includes one or more support ridges, a pedestal, or other beverage container support means to support the bottom of the can or bottle above the holder bottom to create a space for an ice or an ice and water cooling medium. A sealing means between the holder and the beverage container permits the beverage container and the holder to be tipped for drinking without spilling the ice or ice and water used to provide the cooling. Various sealing means include a removable seal subassembly, a single piece gasket that fits on the holder, a seal ring, and a stretch membrane.

14 Claims, 9 Drawing Sheets

CANNED AND BOTTLED BEVERAGE HOLDER

RELATED APPLICATIONS

This application is a continuation-in-part of U.S. application Ser. No. 09/591,921, filed Jun. 12, 2000, now abandoned and is related to U.S. application Ser. No. 09/730,693.

FIELD OF INVENTION

This invention relates to a method and apparatus for a beverage container holder to keep beverage cans and beverage bottles cool while allowing a user to drink from the can or bottle in the holder without spilling the ice or water used to provide the cooling.

BACKGROUND

The embodiments of this invention permit a person to place a beverage can or beverage bottle into a beverage container holder along with ice or ice and ice water, and to periodically drink from the can or bottle. A sealing means permits the user to tip the holder and to drink from the beverage container without spilling the ice or water. The beverage container is placed in the holder; and the sealing means, the housing, and the beverage container form a sealed enclosure to hold the ice and water between the beverage container and the holder housing.

The beverage container is typically supported above the bottom of the holder by ridges or pedestals that support the bottom of the beverage container. This clearance provides space for a cooling medium such as ice or ice and water. The cooling medium can be replaced in order to provide immediate additional refrigeration to the beverage.

SUMMARY

The embodiments of the current invention include a housing which is larger in diameter than a beverage can or beverage bottle. One embodiment of the invention is a removable seal subassembly comprised of a compliant seal and a seal containment means which establish a leak-proof seal between a portion of the beverage can or bottle and the housing. The housing typically includes a support means to support the bottom of the can or bottle above the housing bottom in order to create a space for an ice or an ice and water cooling medium. In another embodiment, the seal means may be a single element that is attached to or secured in the housing.

BRIEF DESCRIPTION OF THE DRAWINGS

These and other objects and advantages of the present invention are set forth below and further made clear by reference to the drawings, wherein.

DESCRIPTION OF EMBODIMENT

Beverage Container Holder With Removable Seal Subassembly

Figure 1B:
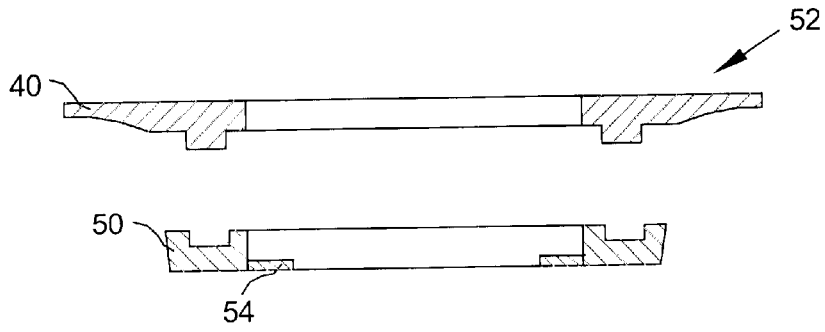
FIG. 1B is a detailed cross-sectional view of the sealing means and the seal containment means of the embodiment of FIG. 1A.
Figure 1C:
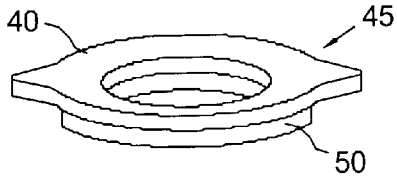
FIG. 1C is a top perspective view of the tabbed seal subassembly of FIG 1A.
Figure 1A:
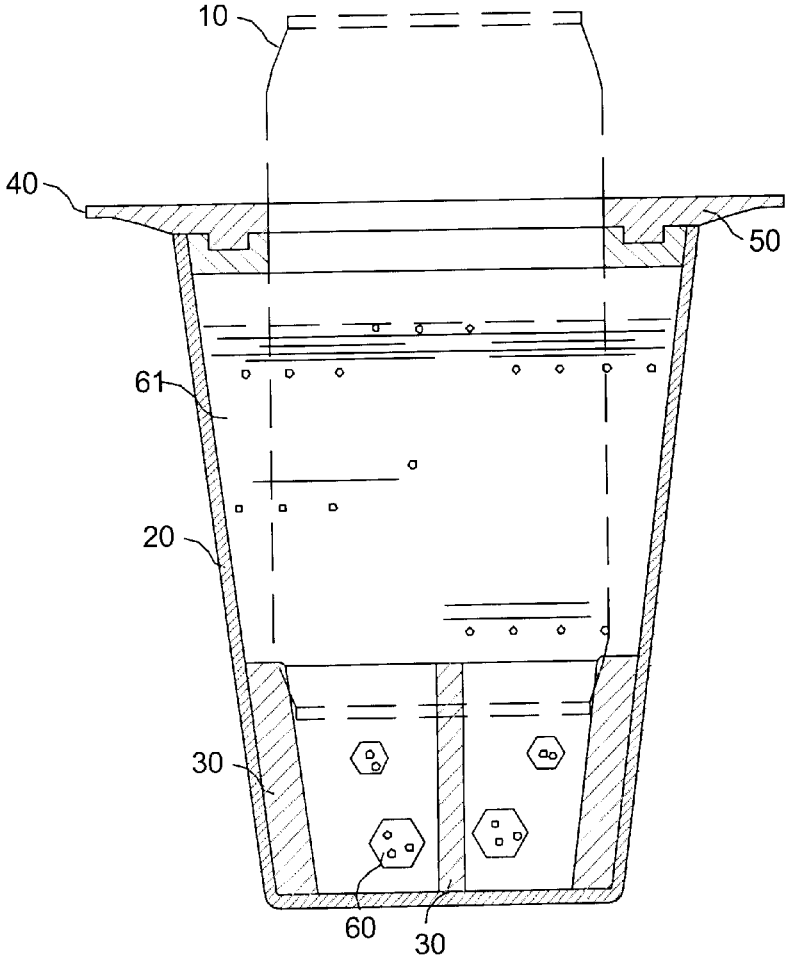
FIG. 1A is a side cut-away view of a beverage can holder with a tabbed seal subassembly.

Referring to FIG. 1A, a beverage holder embodiment of the current invention includes a tumbler housing 20 that is designed to hold a beverage can 10. A similar embodiment may also be used as a beverage bottle holder.

The figure illustrates a beverage can supported above the bottom of the housing by three support ridges 30 which serve as a container support means so that there is room below the can for a water-based coolant of ice, frigid water, or ice and water to be added to the housing in order to provide cooling to the can.

The width of the housing is slightly larger than the beverage container to permit additional ice and water to be in contact with a portion of the sides of the beverage container. The housing has an upper opening that is larger than the beverage container, and a seal containment means 40 is placed along a portion of the circumference of this upper opening so that the seal containment means provides support and constraint for a compliant sealing means 50 which is positioned below the seal containment means.

In this embodiment, the seal containment means 40 and the compliant sealing means 50 form a seal subassembly 45 that is removable. The seal subassembly serves to hold the beverage container in place as the holder is tipped for drinking from the beverage container, and the sealing means prevents ice 60 and water 61 from escaping from the housing while the user is tipping the holder to drink from the beverage container. In alternate embodiments, the seal containment means and the compliant sealing means may be affixed to the housing.

This embodiment describes a seal subassembly that is held in place between the beverage container and the housing by a compression fit. Alternate embodiments for holding or compressing the compliant sealing means in place include screwing the seal containment means to the housing, securing the compliant sealing means over a lip on the housing, and positioning a compliant sealing means within a channel on the housing. The housing is preferably injection molded from polypropylene, although other materials and production methods may be employed. The housing is preferably in the shape of a tumbler with a bottom diameter of about 2.7 inches so that it will fit into a cup holder such as those found in automobiles, boats, and golf carts. In this embodiment, a beverage can is supported at a height of about 1.4 inches above the bottom of the housing. The support ridges are shown extending to the bottom of the housing in order to permit them to be fabricated with the housing by injection molding. Alternate container support means include one or more support pedestals, a support shelf, or a tapered portion of the housing wall.

The housing has an overall height of about 5.1 inches, so that about 1.1 inches of a standard beverage can is exposed above the housing to permit the user to drink from the can. These dimensions support most 12-ounce beverage cans.

Referring now to FIG. 1B, which is a detailed cross sectional detail of this embodiment, the seal containment means includes a pair of tabs 52 located approximately 180 degrees apart. These tabs provide a leveraging mechanism to assist in removing the seal subassembly from the housing. Lifting a tab also permits the release of positive pressure or negative pressure from the space between the beverage container and the housing, thereby permitting the beverage container and seal subassembly to be removed more easily from the housing. The compliant sealing means 50 preferably includes a flap extension 54 which permits the sealing of various diameters of beverage containers. When the seal subassembly is inserted over a can or bottle, the flap extension will bend to accept cans or bottles of different diameters.

Referring now to FIG. 1C, a polypropylene seal containment means 40 is separately fabricated, preferably by injection molding. The compliant sealing means 50 is a Dynaflex G7940 thermoplastic rubber compound, Braton™ copolymer, or similar type of compliant material. One method of manufacturing the seal subassembly is to mold the seal containment means and then to over-mold the compliant sealing means over the seal containment means. This process provides a good bond between the seal containment means and the compliant sealing means. The compliant sealing means and the polypropylene seal containment means may be assembled together with other methods such as glue.

In typical operation, either ice or an ice and water mixture is added to the holder before the can is placed in the container. The can or bottle is then placed into the top opening until it contacts the support ridges or ice which has been placed in the housing. The support ridges assure adequate space for ice and prevent the can or bottle from disappearing into the container. The seal subassembly is then placed over the top of the can so that it engages the can or bottle as the seal subassembly is pushed into the housing, thereby creating a seal between the housing and the beverage holder.

Description of Embodiment

Beverage Container Holder With Removable Snap on Seal Subassembly

Figure 2B:
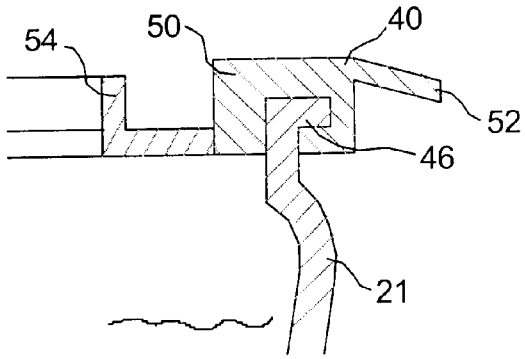
FIG. 2B is a detailed cross-sectional view of the sealing means and the seal containment means of the embodiment of FIG. 2A.
Figure 2A:
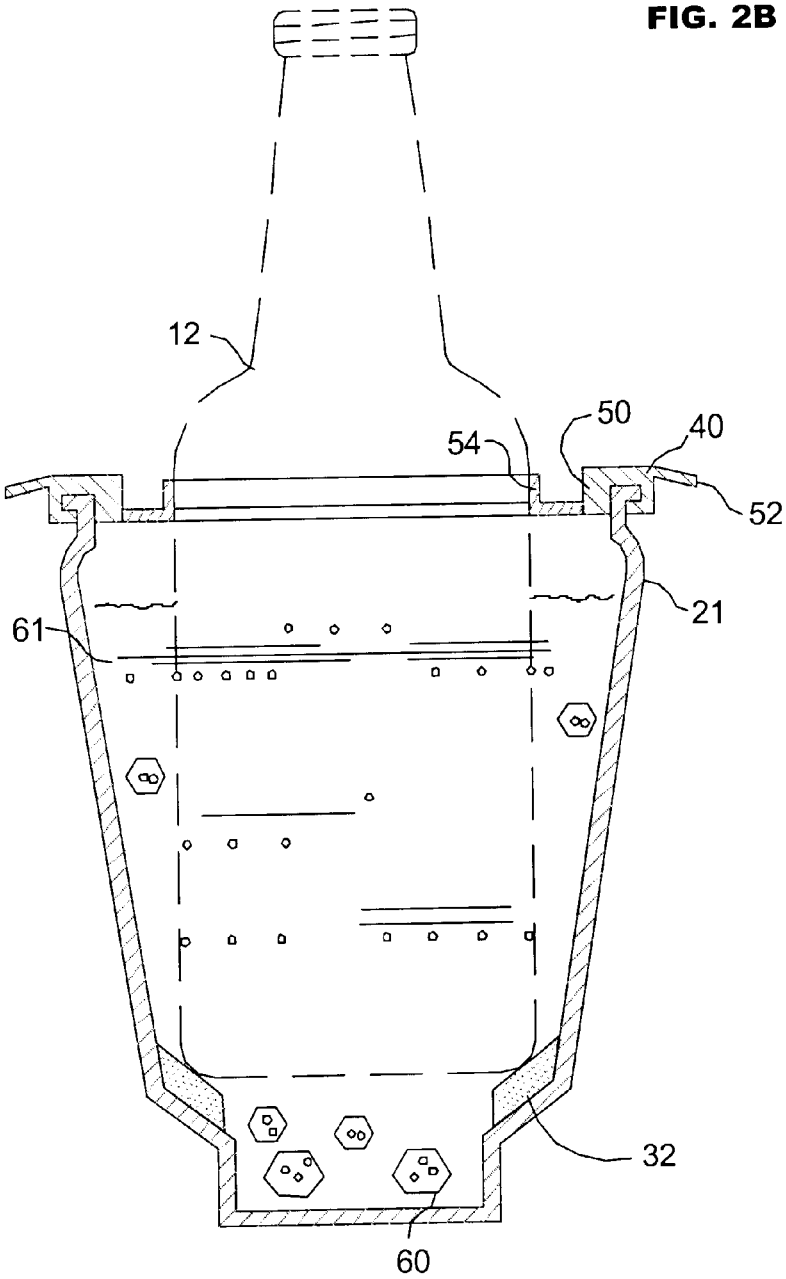
FIG. 2A is a side cut-away view of an alternate housing beverage bottle holder with a tabbed seal subassembly.

Referring to FIG. 2A, another can or bottle holder embodiment of the current invention includes an alternate shaped housing 21 and a seal subassembly that fits over a lip 46 of the housing. The figure illustrates a bottle 12 as the beverage container, although a beverage can may also be used with this beverage container holder. The beverage container is supported above the bottom of the housing by a plurality, preferably three or more, ridges 32 so that there is room below the can for ice or ice and water to be added to the housing in order to provide cooling to the can. Other container support means may be used including one or more pedestals or the housing side wall. The housing may be of a variety of shapes. The figure illustrates a housing with a tapered lower section that is smaller in diameter than the tapered upper section. The housing shape preferably permits room for holding the ice or water around the beverage container while still maintaining a small bottom diameter so that the housing will fit in most cup holders.

The housing has an upper opening that is larger than the beverage container, and a snap on seal containment means 50 is placed on a lip 46 around the circumference of this upper opening so that the seal containment means provides support and constraint for a compliant sealing means 54 which is positioned on the seal containment means. In this embodiment, the compliant sealing means is similar to the flexible flap extension of the previous embodiment. In an alternative embodiment, the seal subassembly may be positioned directly on the upper edge of the housing, without the use of a retaining lip. The housing may be double-walled with a clearance between the inner and outer walls to reduce the condensation on the outside of the holder. Alternately the housing may be constructed from a single layer of material; or from two or more layers of different materials with no air gap between the layers.

The seal containment means 50 and the compliant sealing means 54 form a seal subassembly that is removable. The seal subassembly serves to hold the can in place as the holder is tipped for drinking from the can, and the sealing means prevents the water-based coolant ice 60 and water 61 from escaping from the housing while the user is tipping the holder to drink from the can.

In this embodiment, the bottle holder is the same device as the can holder, and the compliant seal serves as a flexible flap extension to adapt to beverage containers of different diameters. For instance, the flexible flap extensions permit the holder to seal against both beverage cans and beverage bottles. In other embodiments, the bottle holder may have a taller housing and a slightly smaller opening in the compliant sealing means to accommodate a bottle.

The housing is preferably injection molded from polypropylene, although other materials and production methods may be employed. The housing is preferably in the shape of a tumbler with a bottom diameter of about 2.7 inches so that it will fit into a cup holder such as those found in automobiles, boats, and golf carts. In this embodiment, the beverage container is supported at a height of about 1.4 inches above the bottom of the housing. The support ridges 32 are shown extending to the lower taper section of the housing in order to permit them to be fabricated with the housing by injection molding. Other container support means including pedestals, shelves, or the tapered sidewall of the housing may be used. The housing has an overall height of about 5.1 inches, so that about 1.1 inches of a standard beverage can is exposed above the housing to permit the user to drink from the can. These dimensions support most 12-ounce beverage cans.

Referring now to FIG. 2B, which is a detailed cross sectional detail of this embodiment, the seal containment means includes a pair of tabs 52 located approximately 180 degrees apart. These tabs provide a leveraging mechanism to assist in removing the seal subassembly from the housing. Lifting a tab creates a gap along a portion of the lip 46 and permits the release of positive pressure or negative pressure from the space between the beverage container and the housing, thereby permitting the beverage container and seal subassembly to be removed more easily from the housing.

Figure 3B:
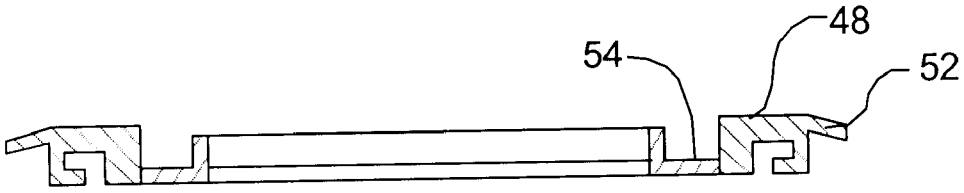
FIG. 3B is a cross-sectional view of a tabbed seal subassembly of FIGS. 2A–2B.
Figure 3A:
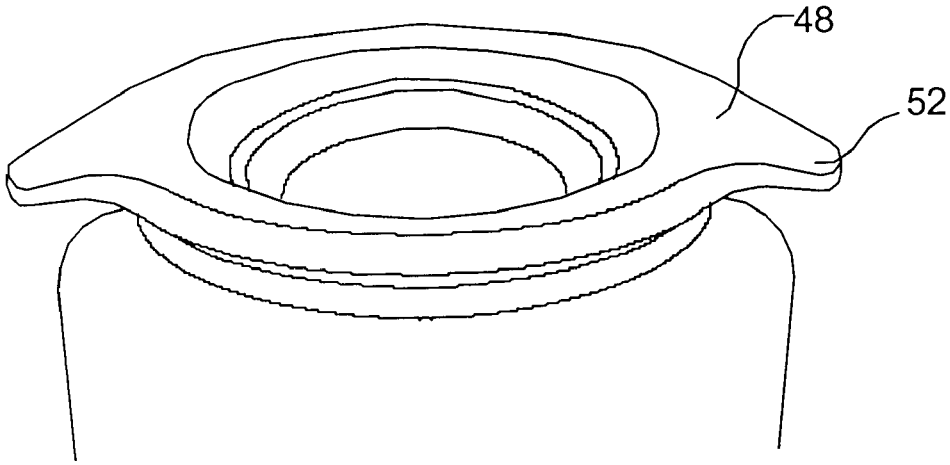
FIG. 3A is a top perspective view of a tabbed seal subassembly of FIGS. 2A–2B.

Referring now to FIGS. 3A and 3B, a polypropylene seal containment means 48 is separately fabricated, preferably by injection molding. The compliant sealing means 54 is a Dynaflex G7940 thermoplastic rubber compound, Braton™ copolymer, or similar type of compliant material. One method of manufacturing the seal subassembly is to mold the seal containment means and then to over-mold the compliant sealing means over the seal containment means. This process provides a good bond between the seal containment means and the compliant sealing means. The compliant sealing means and the polypropylene seal containment means may be assembled together with other methods such as glue.

In typical operation, a water-based coolant such as ice or an ice and water mixture is added to the holder before the can is placed in the container. The can is then placed into the top opening until it contacts the support ridges or ice which has been placed in the housing. The support ridges assure adequate space for ice and prevent the can from disappearing into the container. The seal subassembly is then placed over the top of the can so that it engages the can as the seal subassembly is snapped onto the housing, thereby creating a seal between the housing and the can.

Description of Embodiment

Alternate Snap on Seal Subassembly

Figure 2C:
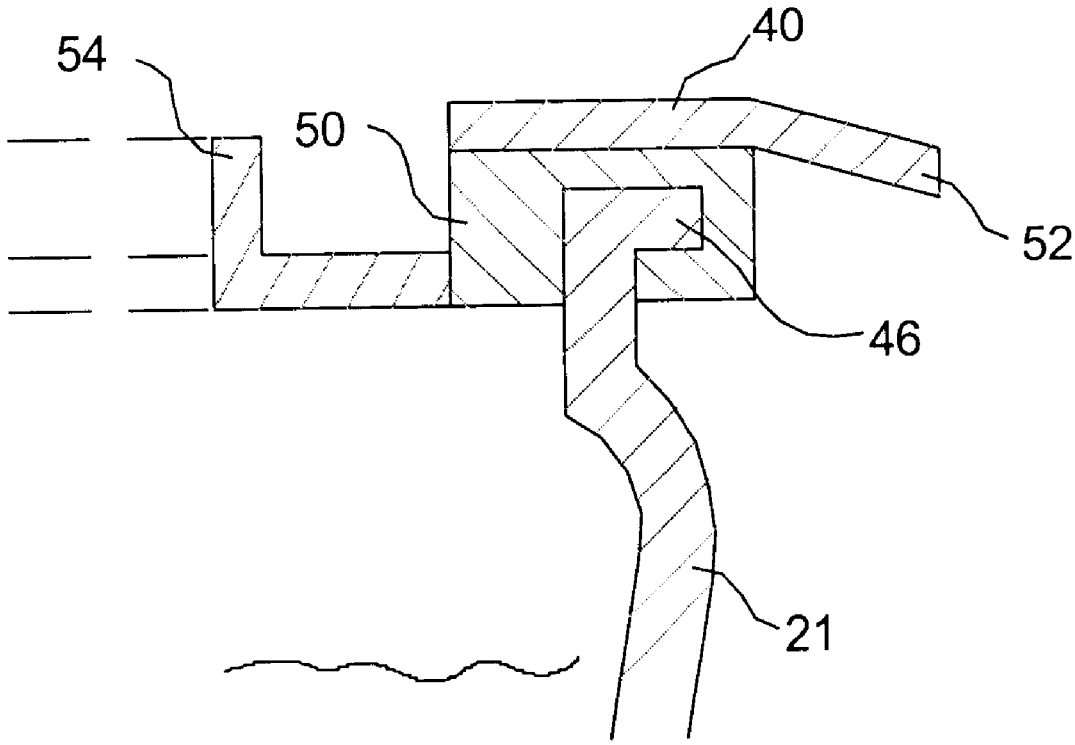
FIG. 2C is a detailed cross-sectional view of an alternate sealing means and the seal subassembly of the embodiment of FIGS. 2A and 1A.

Referring now to FIG. 2C, an alternate seal subassembly may be provided for the above embodiments. This embodiment includes a compliant sealing means 50 which fits over the lip 46 on the housing 21. The seal containment means 40 provides support for the compliant sealing means, and preferably includes tabs 52 for releasing the seal subassembly from the housing. A compliant sealing flap extension 54 may be used in order to permit use of various diameters of beverage containers.

Description of Embodiment

Can Holder Seal Containment

Figure 4:
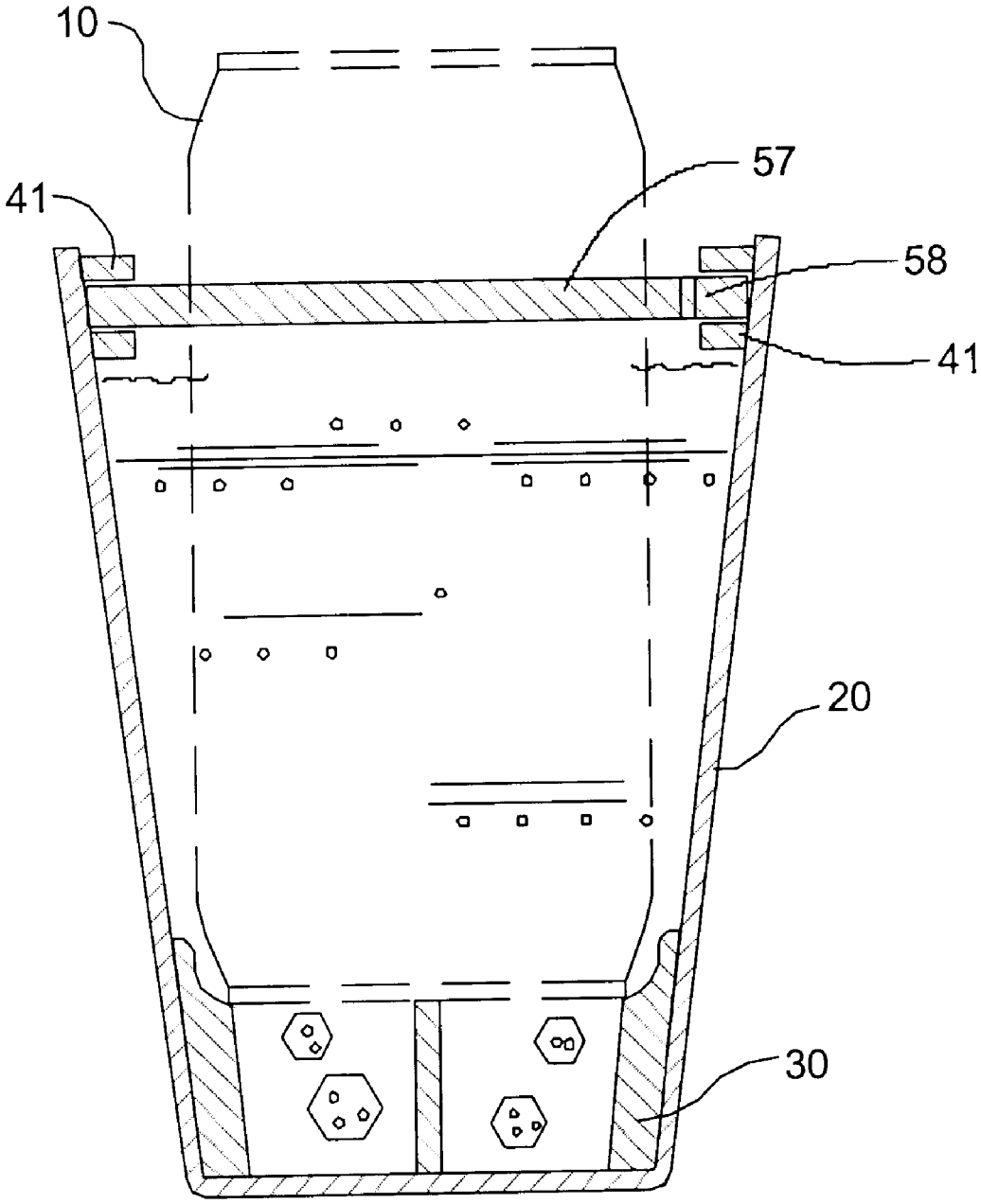
FIG. 4 is a side cross-sectional view of a can holder embodiment with a compliant sealing ring means.

Referring now to FIG. 4, another embodiment of the current invention includes a tumbler housing 20 holding a beverage can 10 or bottle. The can or bottle is supported above the bottom of the housing by three support ridges 30 or by other container support means. In this embodiment, the slotted seal containment means 41 provides a groove to accept a compliant sealing ring 57. The compliant sealing ring preferably includes one or more vents 58 to permit pressure and vacuum release when installing and removing the container.

The slotted seal containment means may be fabricated separately and then attached to the housing, or both the housing and the seal containment means may be fabricated as a single unit. Alternately, the compliant sealing ring is removable.

The compliant sealing ring 51 is a Dynaflex G7940 rubber seal, or similar type of compliant material. The compliant sealing ring may be inserted into the groove either before or after assembly of the slotted seal containment means to the housing.

Description of Embodiment

Bottle Holder with Seal Lid

A bottle holder embodiment of the current invention may be produced in the same manner as the above-described can holder embodiment. The bottle holder preferably has a taller housing, and the seal lid preferably has a slightly smaller opening to accommodate a bottle.

Description of Embodiment

Beverage Container Holder with Screw-on Seal Containment

Figure 5B:
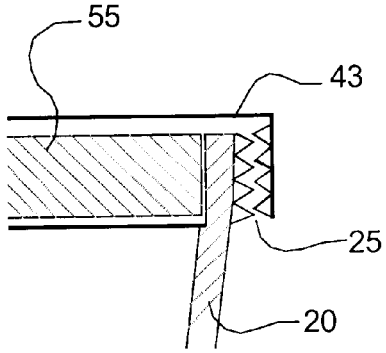
FIG. 5B is a detailed cross-sectional view of the sealing means and the seal containment means of the embodiment of FIG. 5A.
Figure 5A:
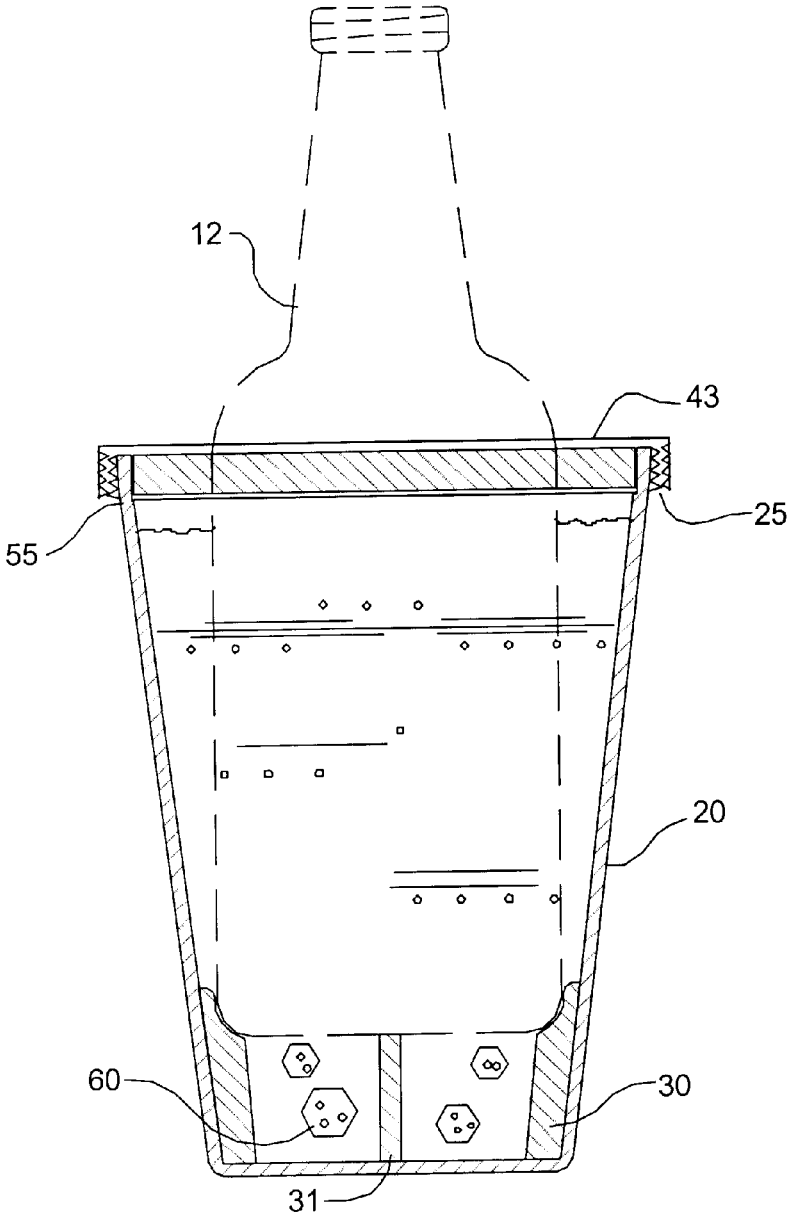
FIG. 5A is a side cross-sectional view of a beverage container holder embodiment with a screw-on sealing means.

Referring now to FIG. 5A, another beverage container holder embodiment of the current invention includes a screw on lid 43 which screws onto the threaded upper portion of the housing 20.

Referring now to FIG. 5B, a complaint sealing ring 55 is held in place between the top of the housing and the lid. In this embodiment, the compliant sealing ring 55 is not permanently attached to either the housing 20 or to the screw on lid 43. When the lid is threaded onto the housing, the compliant sealing ring is compressed against the housing wall, and tends to expand into the beverage container. In an alternate embodiment, the compliant sealing ring may be compressed between the lid and a ledge integral to the housing.

This embodiment permits interchangeable lids to be used so that the holder can be used for either cans or bottles.

Description of Embodiment

Beverage Container Holder with Integral Screw-on Seal

Figure 6B:
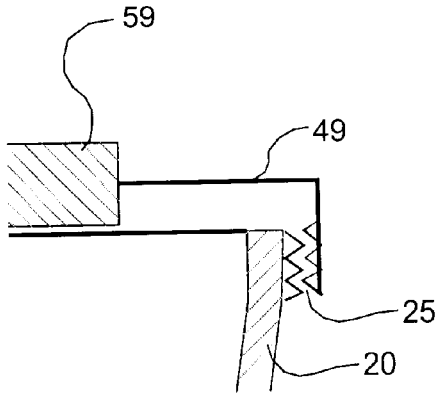
FIG. 6B is a detailed cross-sectional view of the sealing means and the seal containment means of the embodiment of FIG. 6A.
Figure 6A:
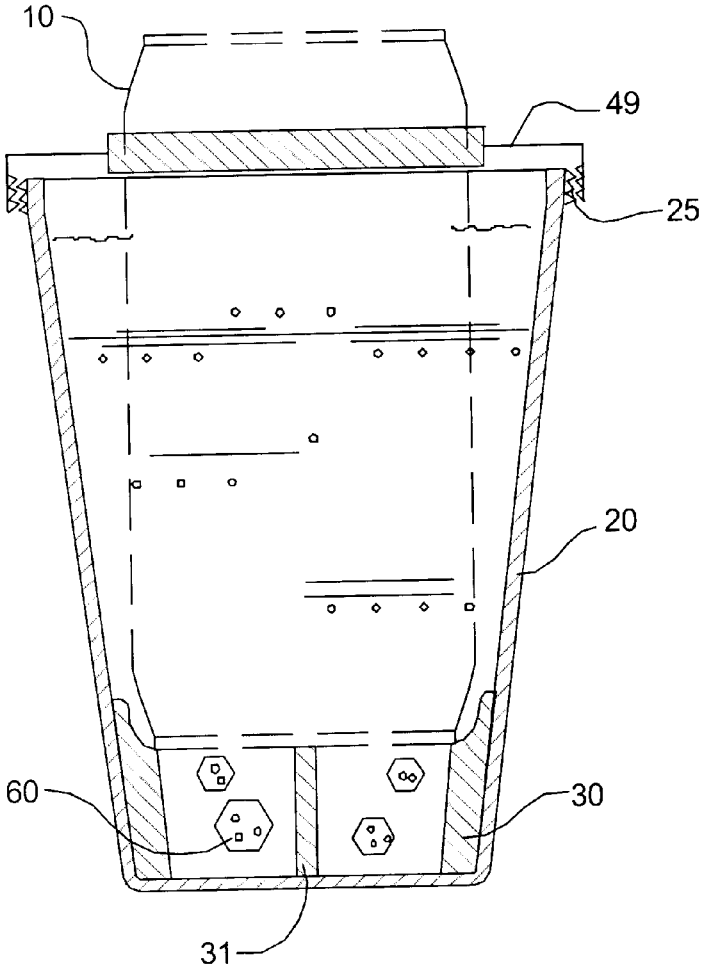
FIG. 6A is a side cross-sectional view of another beverage container holder embodiment with a screw-on sealing means.

Referring now to FIG. 6A, another beverage container holder embodiment of the current invention includes a screw on lid 49 which screws onto the threaded upper portion of the housing 20. The lid serves as a seal containment means.

Referring now to FIG. 6B, the complaint sealing ring 59 is integral to the lid 49. This embodiment permits interchangeable lids to be used so that the holder can be used for either cans or bottles.

Description of Embodiment

Beverage Container Holder with Seal Membrane Lid

Figure 7B:
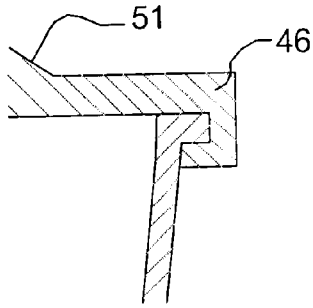
FIG. 7B is a detailed cross-sectional view of the sealing means and the seal containment means of the embodiment of FIG. 7A.
Figure 7A:
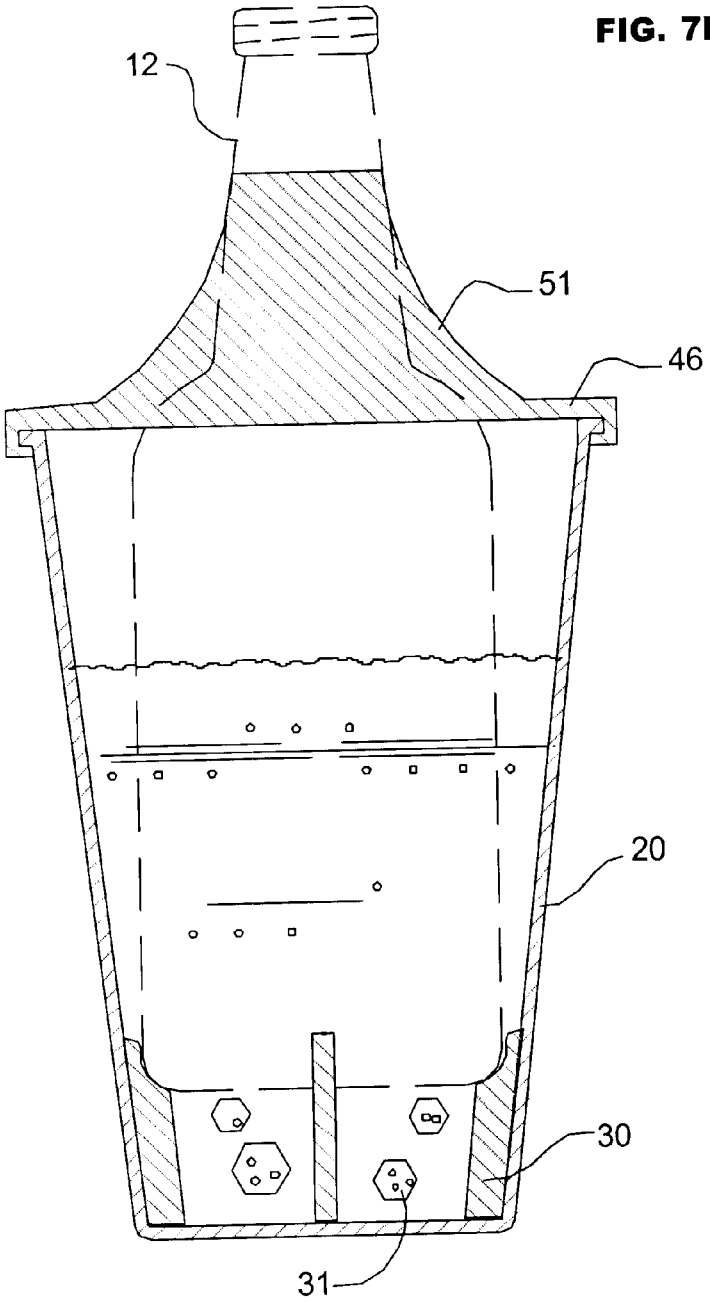
FIG. 7A is a side cross-sectional view of a beverage bottle holder embodiment with a membrane snap on sealing means.

Referring now to FIG. 7A, another beverage container holder embodiment of the current invention includes a seal membrane lid 51 which serves as a compliant sealing means between the bottle 12 and the housing 20.

Referring now to FIG. 7B, which is a cross sectional detail of this embodiment, the seal is grooved along its edge to provide a pressure fit on the external lip 46 of the housing. In this embodiment, the lip serves as the seal containment means. This embodiment permits interchangeable seal membrane lids to be used so that the holder can be used for either cans or bottles.

Figure 7C:
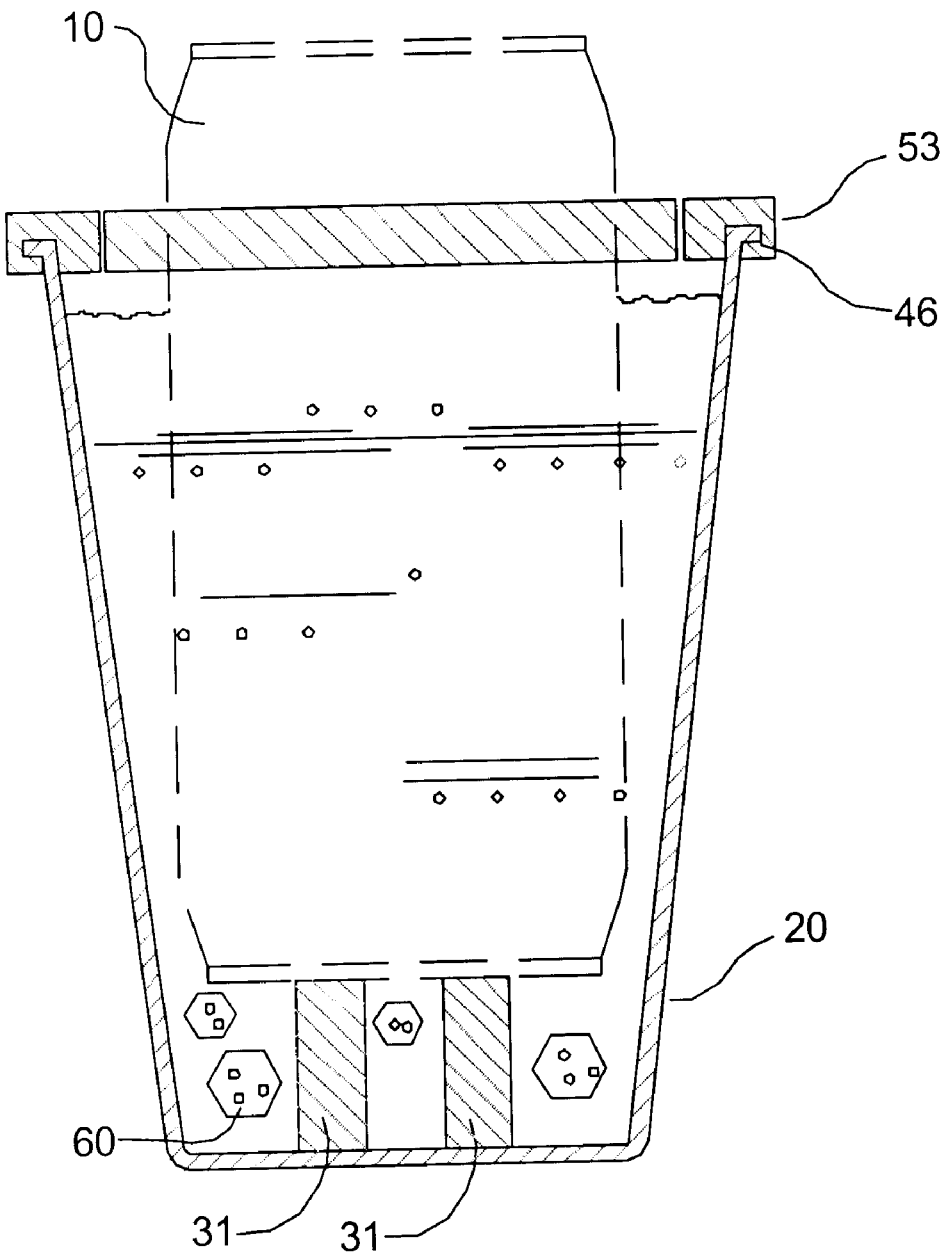
FIG. 7C is a side cross-sectional view of a beverage can holder embodiment with a membrane snap on sealing means.

Referring now to FIG. 7C, a can holder embodiment of the current invention includes a compliant seal lid 53 which snaps onto an external lip 46 of the housing 20 to provide a seal to the beverage can or bottle without requiring an additional seal containment means. In the illustration, the can is shown to be supported by a plurality of pedestals 31. Other can supporting means may be employed, including support ridges as shown in previous illustrations.

These examples are for the purpose of illustration, and it would be known to one skilled in the art to substitute other various housing shapes, beverage container support designs, and seal configurations.

What is claimed is:

1. A holder for a beverage container comprising:

a housing such that the beverage container will reside substantially inside the housing, the housing including a bottom, at least one beverage container support means that supports the beverage container above the bottom of the housing, thereby permitting a water-based coolant to be placed in the housing, such that a substantial portion of the water-based coolant is positioned below the beverage container, a side wall having an inside surface and an exterior surface, the side wall creating an annular space between a portion of the exterior of the beverage container and the inside surface of the side wall, whereby a water-based coolant may be placed in the annular space and directly contact a portion of the beverage container, and a top opening; and a detachable seal subassembly, such that the detachable seal subassembly may be placed on the beverage container after the beverage container is placed in the housing, and such that the detachable seal subassembly and the beverage container may be removed from the housing after the contents of the beverage container have been consumed, the detachable seal subassembly comprising a sealing means, a seal containment means positioned along the upper circumference of the housing such that the seal containment means reinforces the sealing means and assists in holding the sealing means in place against a portion of the exterior of the beverage container, such that the sealing means and the seal containment means prevent leakage of the water-based coolant from the annular space when the housing is tilted, and at least one release tab such that the tab may be lifted in order to permit removal of the beverage container and the seal subassembly.

2. The holder of claim 1 wherein the seal subassembly includes two release tabs.

3. A holder for a beverage container comprising:

a housing such that the beverage container will reside substantially inside the housing, the housing including a bottom, at least one beverage container support means that supports the beverage container above the bottom of the housing, thereby permitting a water-based coolant to be placed in the housing, such that a substantial portion of the water-based coolant is positioned below the beverage container, a side wall comprising a first inner wall and a second outer wall, such that there is a clearance between the first inner wall and the second outer wall, the inner wall having an inside surface such that there is an annular space between a portion of the exterior of the beverage container and the inside surface of the first inner wall, whereby a water-based coolant may be placed in the annular space and directly contact a portion of the beverage container, and a top opening; and a detachable seal subassembly, such that the detachable seal subassembly may be placed on the beverage container after the beverage container is placed in the housing, and such that the detachable seal subassembly and the beverage container may be removed from the housing after the contents of the beverage container have been consumed, the detachable seal subassembly comprising a sealing means, and a seal containment means positioned along the upper circumference of the housing such that the seal containment means reinforces the sealing means and assists in holding the sealing means in place against a portion of the exterior of the beverage container, such that the sealing means and the seal containment means prevent leakage of the water-based coolant from the annular space when the housing is tilted.

4. The holder of claim 1 wherein the housing is tapered.

5. The holder of claim 4 wherein the housing has a first upper taper profile, and a second lower taper profile.

6. The holder of claim 1 wherein the beverage container support means is a plurality of support ridges.

7. The holder of claim 1 wherein the beverage container support means is at least one pedestal.

8. The holder of claim 1 wherein the beverage container support means is a portion of the internal wall of the housing.

9. The holder of claim 1 wherein the water-based coolant coolant medium is ice.

10. The holder of claim 1 wherein the water-based coolant is a mixture of ice and water.

11. A holder for a beverage can comprising:

a tapered housing with a can support means such that the can will reside substantially inside the housing and be supported above the bottom of the housing, thereby permitting a water-based coolant to be placed in the housing, such that a substantial portion of the water-based coolant is positioned below the beverage can, the housing including a bottom, a double side wall having a first inside wall with an inside surface and a second outside wall, the double side wall creating an annular space between a portion of the exterior of the can and the inside surface of the side wall, whereby a water-based coolant can be placed in the annular space and directly contact a portion of the beverage can, and a top opening; and a detachable seal subassembly, such that the detachable seal subassembly may be placed on the beverage can after the beverage can is placed in the housing, and such that the detachable seal subassembly and the beverage can may be removed from the housing after the contents of the beverage can have been consumed, the detachable seal subassembly comprising a sealing means, a seal containment means positioned along a lip on the upper circumference of the housing such that the seal containment means reinforces the sealing means and assists in holding the sealing means in place against a portion of the exterior of the can, such that the sealing means and the seal containment means prevent leakage of the water-based coolant from the annular space when the housing is tilted; and at least one release tab such that the tab may be lifted in order to allow air into the space between the sealing means and the housing in order to assist in releasing the seal subassembly from the housing.

12. A holder for a beverage bottle comprising:

a tapered housing with a bottle support means such that the bottle will reside substantially inside the housing and be supported above the bottom of the housing, thereby permitting a water-based coolant to be placed in the housing, such that a substantial portion of the water-based coolant is positioned below the beverage can, the housing including a bottom, a double side wall having a first inside wall with an inside surface and a second outside wall, the double side wall creating an annular space between a portion of the exterior of the bottle and the inside surface of the side wall, whereby a water-based coolant may be placed in the annular space and directly contact a portion of the beverage bottle, and a top opening; and a detachable seal subassembly, such that the detachable seal subassembly may be placed on the beverage bottle after the beverage bottle is placed in the housing, and such that the detachable seal subassembly and the beverage bottle may be removed from the housing after the contents of the beverage bottle have been consumed, the detachable seal subassembly comprising a sealing means, a seal containment means positioned along a lip on the upper circumference of the housing such that the seal containment means reinforces the sealing means and assists in holding the sealing means in place against a portion of the exterior of the bottle, such that the sealing means and the seal containment means prevent leakage of the water-based coolant from the annular space when the housing is tilted; and at least one release tab such that the tab may be lifted in order to assist in releasing the seal subassembly from the housing.

13. A holder for a beverage can comprising:

a truncated conical tumbler housing such that the beverage can will reside substantially inside the housing, the housing including a truncated bottom portion, a side wall having an inside surface and an exterior surface, the side wall creating an annular space between a portion of the exterior of the can and the inside surface of the side wall, at least three support ridges integral to the bottom portion of the inside surface of the side wall, such that the ridges support the bottom of the beverage can above the bottom of the housing, thereby permitting ice and ice water to be placed in the housing, such that a substantial portion of ice and ice water is positioned below the beverage can, and a top opening;

a detachable seal subassembly positioned within a portion of the housing such that the seal subassembly creates a seal between a portion of the exterior of the can and a portion of the housing, thereby preventing leakage of the coolant medium from the annular space when the housing is tilted, the seal subassembly comprising:

a compliant seal means having a flexible flap extension, and a seal containment means having a pair of integral tabs.

14. A holder for a beverage bottle comprising:

a truncated conical tumbler housing such that the beverage bottle will reside substantially inside the housing, the housing including a truncated bottom portion, a side wall having an inside surface and an exterior surface, the side wall creating an annular space between a portion of the exterior of the can and the inside surface of the side wall, at least three support ridges integral to the bottom portion of the inside surface of the side wall, such that the tabs support the bottom of the beverage bottle above the bottom of the housing, thereby permitting ice and ice water to be placed in the housing, such that a substantial portion of ice and ice water is positioned below the beverage bottle, and a top opening;

a detachable seal subassembly positioned within a portion of the housing such that the seal subassembly creates a seal between a portion of the exterior of the bottle and a portion of the housing, thereby preventing leakage of the coolant medium from the annular space when the housing is tilted, the seal subassembly comprising:

a compliant seal means having a flexible flap extension, and a seal containment means having a pair of integral tabs.

* * * * *